United States Patent [19]

Schniter

[11] Patent Number: 4,717,140

[45] Date of Patent: Jan. 5, 1988

[54] STREAM FEEDER APPARATUS FOR PRINTED SHEETS

[75] Inventor: Jorg Schniter, Glenview, Ill.

[73] Assignee: R. R. Donnelley & Sons Company, Chicago, Ill.

[21] Appl. No.: 869,304

[22] Filed: Jun. 2, 1986

[51] Int. Cl.[4] ..... B65H 3/56

[52] U.S. Cl. ..... 271/168; 271/11; 271/31.1; 271/104; 271/124

[58] Field of Search ..... 271/10, 11, 12, 98, 271/99, 104, 121, 124, 137, 138, 20, 31.1, 149, 150, 151, 167, 168, 129, 165

[56] References Cited

U.S. PATENT DOCUMENTS

| | | | |
|---|---|---|---|
| 1,482,752 | 2/1924 | La Bombard et al. | 271/124 |
| 2,819,077 | 1/1958 | Goss | 271/124 X |
| 3,563,537 | 2/1971 | Thut | 271/124 |
| 3,565,422 | 2/1971 | McCain et al. | 271/95 |
| 3,810,612 | 5/1974 | McCahon et al. | 271/11 |
| 3,880,419 | 4/1975 | Swanson | 271/3.1 |
| 4,177,982 | 12/1979 | Bewersdorf et al. | 271/151 X |
| 4,313,598 | 2/1982 | DiBlasio | 271/124 |

FOREIGN PATENT DOCUMENTS 2625237 2/1977 Fed. Rep. of Germany ..... 271/150

OTHER PUBLICATIONS

3 Pages from instruction manual for Sheridan Model FG Pacesetter Inserter—publication date unknown, but admitted to be prior art.

*Primary Examiner*—Joseph J. Rolla
*Assistant Examiner*—Edward S. Ammeen
*Attorney, Agent, or Firm*—Wood, Dalton, Phillips, Mason & Rowe

[57] ABSTRACT

A stream feeder for moving a shingled stream of signatures forwardly to maintain a small upright stack of signatures at a packer box of a bindery line collator has a transversely extending impaling pin bar movably mounted on a forward end portion of the stream feeder frame, and a line of impaling pins that are individually adjustable in the pin bar have free ends projecting into the path of movement into the packer box of signatures from the small upright stack. Mechanism for moving the pin bar to simultaneously adjust the extent of projection of all the pins includes a manually movable adjustment control member mounted at a position spaced from the pin bar where it is readily accessible to an operator attending the bindery line.

16 Claims, 8 Drawing Figures

STREAM FEEDER APPARATUS FOR PRINTED SHEETS

The invention relates to apparatus, commonly called a stream feeder, for feeding printed signatures in a shingled stream to maintain a small upright stack of signatures at a packer box of a bindery line collator.

BACKGROUND OF THE INVENTION

The present apparatus is of the general type disclosed and claimed in Swanson U.S. Pat. No. 3,880,419. In such apparatus there is a controlled belt feed for moving a shingled stream of signatures forwardly to maintain a small upright stack of signatures at a packer box of a bindery line collator. The packer box separates signatures seriatim from the bottom of the small upright stack and feeds them onto an endless gathering chain that moves along the forward ends of a line of such packer boxes.

One of the difficult aspects of such an apparatus is adjusting it to assure that a single signature is fed from the bottom of the small upright stack on each cycle. As inserters and other types of collators are operated at increasingly high books per minute, the problem of assuring the single signature feed becomes more difficult of solution.

For example, Swanson U.S. Pat. No. 3,880,419 discloses an early stream feeder used with an inserter packer box having a low enough books per minute rate that swinging support hooks could be used to release one signature at a time from the bottom of the small stack.

The present stream feeder is designed particularly for use with packer boxes of a high speed inserter line that can operate at cyclic rates up to 300 books per minute. Even with an inserter packer box provided with an extracting drum that has three sets of grippers (as in McCain U.S. Pat. No. 3,565,422) signatures are removed from the bottom of a small stack at the rate of 100 a minute; and this makes swinging support hooks of the type disclosed in the Swanson patent unsatisfactory.

Fixed, but adjustable, separator pins have been used to cooperate with the usual oscillating suction grippers that are used to separate the bottom signature of a stack from those above it, and such pins are quite satisfactory provided their degree of extension is properly adjusted to the signatures that are being fed. The degree of extension of the separator pins depends upon the number of pages in the signatures and also upon the weight of the stock upon which the signatures are printed.

A four-page signature obviously has totally different handling characteristics from a signature having, for example, 48 pages. Further, printed sheets handle totally differently depending upon whether they are of 22 pound stock (typical telephone directory), or 60 pound stock (coated paper for color printing as used in periodicals of the highest quality), or something in between those two limits, or card stock which is 80 pounds. Finally, of course, the finish of the sheets—i.e., uncalendared, calendared, super calendared or coated—affects the handling.

Heretofore, separator pins for a signature feeding apparatus have required manual adjustment which, because of the pin location, can only be carried out with the apparatus out of service. Pin adjustment has, heretofore, been quite slow because it had to be done on a "cut and try" basis—i.e., set the pin projection, inch the machine to see if the pins are achieving proper signature separation, stop the machine and readjust if the separation is not right, and continue adjusting and testing until the pin projection is right.

A major factor in achieving overall plant efficiency is minimization of the time required to make any necessary changes or adjustments in the apparatus to go from one job to the next; and a saving of only a few minutes in this "make ready" time can be extremely significant where apparatus delivers as many as 300 books a minute.

SUMMARY OF THE INVENTION

The present invention has as its principal purpose the more efficient use of manpower and equipment in the operation of a high speed signature inserter that is equipped with signature supply means of the stream feeder type.

The principal feature of the present invention is that the impaling pins which assist in separating the signatures are carried in an impaling pin bar which is movable to adjust the extent of projection of all the pins simultaneously, and means for moving the pin bar includes a manually movable adjustment control member mounted at a position spaced from the pin bar where it is readily accessible to an operator who is attending the bindery line.

The impaling pin adjustment of the present invention permits a machine operator to adjust the extent of projection of the impaling pin while the inserter is operating at fast or slow speed, thus eliminating the previous "cut and try" impaling pin adjustment.

THE DRAWINGS

DETAILED DESCRIPTION OF THE INVENTION

Figure 1:
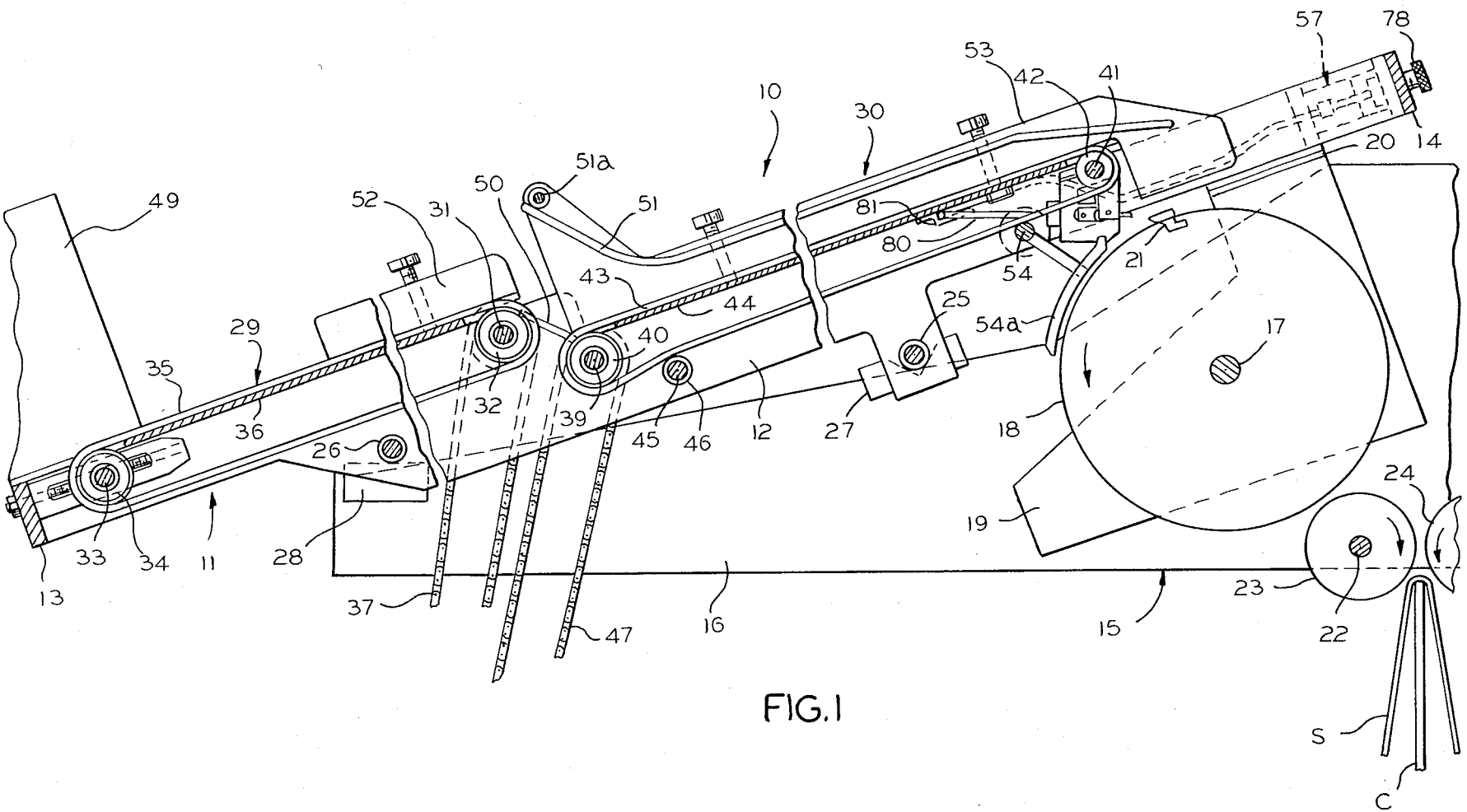
FIG. 1 is a schematic, broken, longitudinal sectional view of a stream feeder embodying the invention, shown in its operative relationship to a schematically illustrated inserter, the view being taken substantially as indicated along the line 1—1 of FIG. 2.
Figure 2:
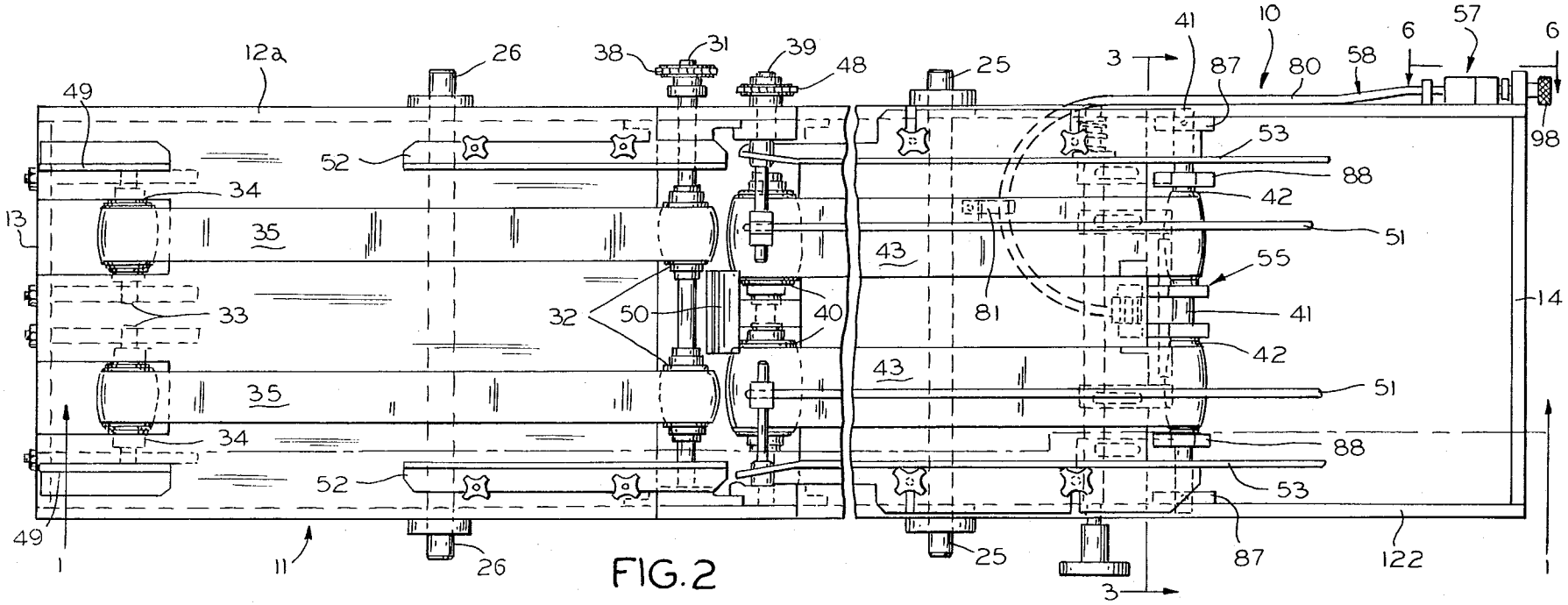
FIG. 2 is a broken, schematic, plan view of the apparatus of FIG. 1 with the inserter parts eliminated.

Referring to the drawings in detail, and referring first to FIGS. 1 and 2, a stream feeder, indicated generally at 10, consists of a frame, indicated generally at 11, that has longitudinal side frame members **12*a* and 12*b*, a rear cross member 13 and a front cross member 14. Several additional cross members and cross shafts serve to make the frame 11** very rigid.

An inserter packer box is illustrated very schematically and is indicated generally at 15. The inserter packer box includes a pair of side frame plates such as the plate 16 seen in FIG. 1, a rotatable extracting drum shaft 17 that carries an extracting drum 18, a mounting frame of which one side plate 19 is illustrated that carries a guide plate 20, and suction means of which only suction grippers 21 are illustrated. Also mounted between the frame side plates 16 is a transfer drum shaft 22 that carries a transfer drum 23; and an opener drum shaft (not shown) is also mounted between the side frame plates 16 and carries an opener drum 24 that cooperates with the transfer drum 23 to open signatures S and drop them straddling a collator endless chain C.

The stream feeder 10 is provided with forward mounting bars 25 and rearward mounting bars 26 that seat, respectively, in V blocks 27 and on flat blocks 28 that are fixed to the packer box side plates 16. Thus, the stream feeder 10 may be lowered onto the blocks 27 and 28 by an overhead crane.

The stream feeder 10 has rearward signature feed means, indicated generally at 29, and forward signature feed means, indicated generally at 30.

The rearward feed means 29 includes a drive shaft 31 that carries a pair of drums 32, and axially aligned rear idler shafts 33 that are best seen in FIG. 1 to be mounted for longitudinal adjustment and each of which carries a drum 34. Two signature feed belts 35 are trained around the drums 32 and 34, and ride upon a belt support plate 36. Drive for the belts 35 is from a drive chain 37 that is trained around a sprocket 38 upon the drive shaft 31.

The forward signature feed means 30 includes a rearward drive shaft 39 that carries a pair of drums 40, and a forward idler shaft 41 that carries a pair of drums 42. Belts 43 are trained around the drums 40 and 42 and ride upon a belt support plate 44. An adjustable tensioning shaft 45 journals sleeves 46 that bear upon the belts 43 to provide for adjustment of the belt tension. A chain 47 trained around a sprocket 48 upon the rearward drive shaft 39 powers the belts 43.

At the rear of the stream feeder frame 11 is a pair of laterally adjustable side plates 49 that define a signature hopper in which a large supply of signatures S is supported upon the rearmost portions of the belts 35. The signatures have their closed sides trailing, so that when they are fed onto a small stack supported upon the guide plate 20 of the packer box 15, the trailing closed ends of the signatures are supported upon the separator pins as will be described in more detail hereafter.

An inclined support plate 50 is positioned between the forward ends of the belts 35 and the rearward ends of the belts 43; and above the belts 43 are stream presser rods 51 that have their rear ends pivotally supported upon cross rods **51*a*. Rearward side guides 52 and forward side guides 53 are laterally adjustable to accommodate signatures of different head to tail dimensions, and the hopper side plates 49** are similarly laterally adjustable.

Also carried upon the stream feeder frame 11 is a cross shaft 54 that carries adjustable guide shoes **54*a* which are concentric with the surface of the extracting drum 18**.

It is to be understood, of course, that the stream feeder 10 has numerous controls and other components that are not illustrated in the schematic drawings. Thus, for example, the drive for the belts 35 and 43 is through clutches that are controlled by sensors that detect the height of the small stack of signatures supported upon the guide plate 20, so that signatures are fed forwardly only as they are required to maintain a stack of the proper size at the packer box.

Likewise, mounted at the extreme forward part of the stream feeder frame 11 is a jogger mechanism which includes its own separate fractional horsepower electric motor and jogger arms to constantly jog the signatures on the guide plate 20 into alignment. The jogger mechanism has the customary adjustments to accommodate signatures of different backbone to lap dimension.

Referring now particularly to FIGS. 3 to 8, the impaling pin structure of the present invention includes impaling pin bar mounting means, indicated generally at 55, an impaling pin bar, indicated generally at 56, an adjustment control member, indicated generally at 57, and a mechanical connection, indicated generally at 58, between the adjustment control member 57 and the pin bar 56.

Figure 5:
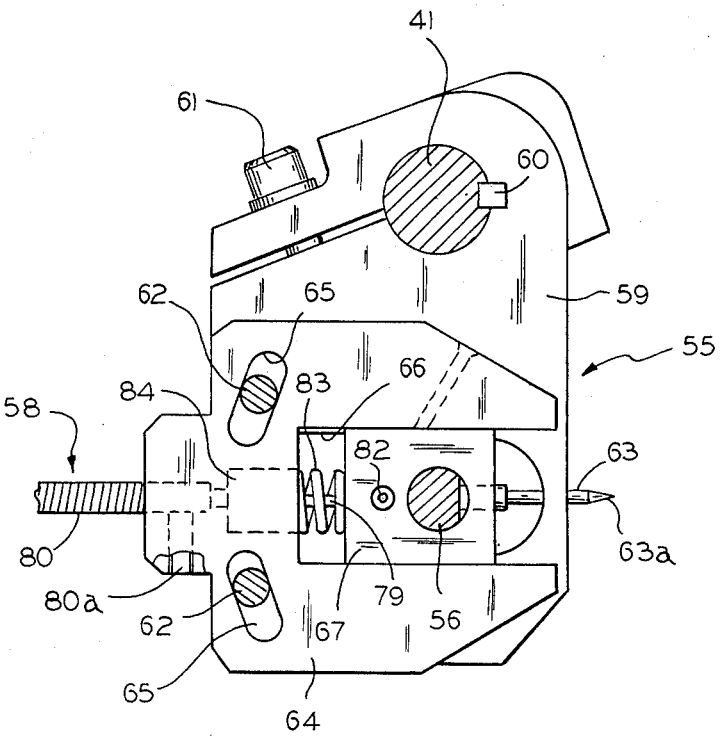
FIG. 5 is a fragmentary sectional view on an enlarged scale taken substantially as indicated along the line 5—5 of FIG. 3.
Figure 4:
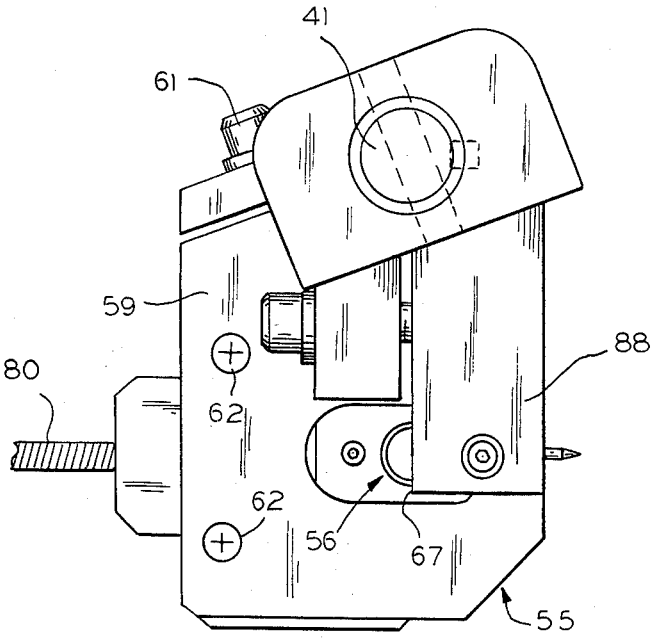
FIG. 4 is an end elevational view on an enlarged scale taken substantially as indicated along the line 4—4 of FIG. 3.

The pin bar mounting means 55 is best seen in FIGS. 4 and 5 to consist of a pair of split blocks 59 that are slotted to engage keys 60 on the forward cross shaft 41; and screws 61 clamp the split blocks 59 onto the cross shaft 41. Extending between the split blocks 59 are pins 62 that are equidistant from the tips **63*a* of impaling pins 63 that are mounted for individual adjustment in the impaling pin bar 56**.

The split blocks 59 provide mounting arms for a bifurcated member 64 that has arcuate slots 65 through which the pins 62 extend. The arc of the slots 65 is concentric about a phantom axis at the tips **63*a* of the impaling pins 63, so that at the most common working position the angle of the bifurcated member 64 relative to the split blocks 59 may be adjusted without changing the location of the tips 63*a*** of the impaling pins.

The bifurcated member 64 has top and bottom arms that define a slideway 66 in which a slide block 67 is mounted for movement that is generally fore and aft with reference to the split mounting blocks 59. A transverse bore in the slide block 67 receives the pin bar 56.

Figure 6:
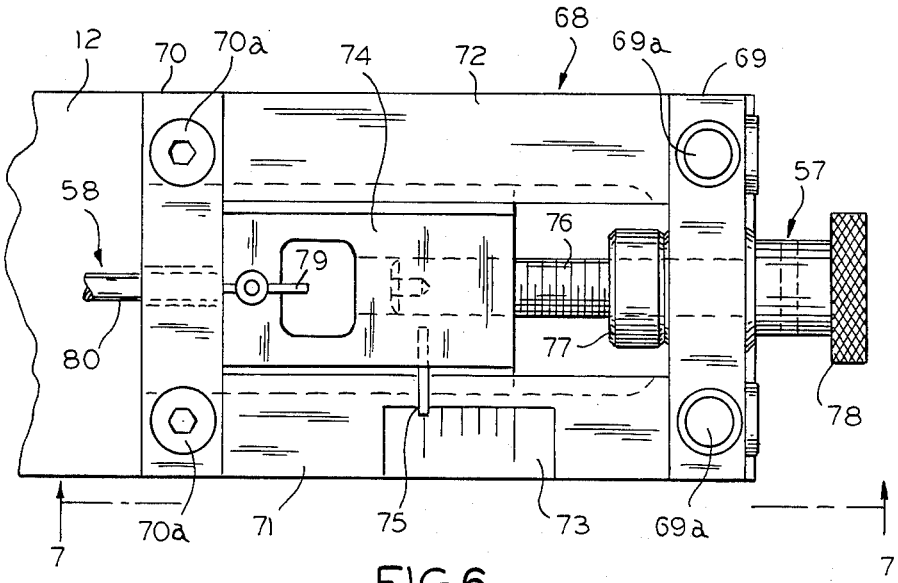
FIG. 6 is a fragmentary side elevational view on an enlarged scale, taken substantially as indicated along the lines 6—6 of FIG. 2, illustrating the manually movable adjustment control member.
Figure 7:
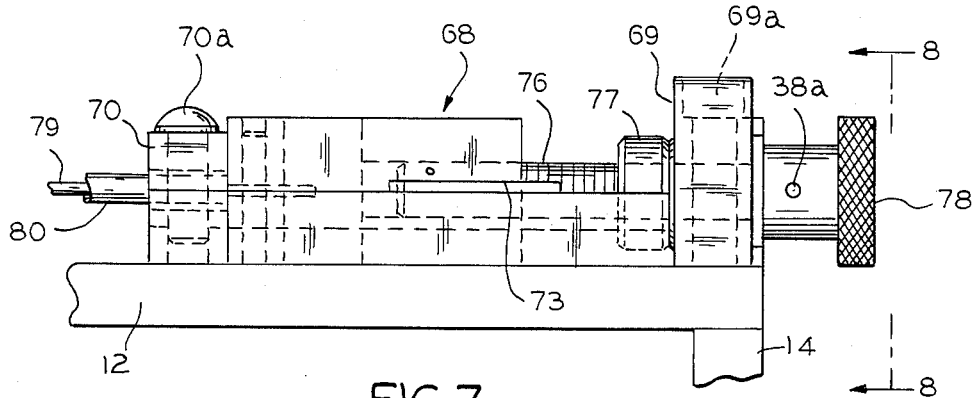
FIG. 7 is a fragmentary plan view taken substantially as indicated along the line 7—7 of FIG. 6.
Figure 8:
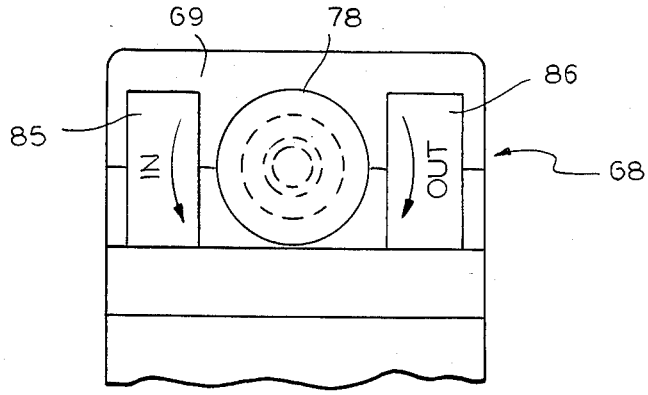
FIG. 8 is a fragmentary front elevational view taken substantially as indicated along the line 8—8 of FIG. 7.

Referring now particularly to FIGS. 6 to 8, an adjustment control assembly, indicated generally at 68, supports the manually movable adjustment control member 57 at the front of the stream feeder side frame member **12*a*. The adjustment control assembly 68 consists of a forward journal block 69 secured by machine screws 69*a* to the side frame member 12*a*, a rearward guide block 70 secured by machine screws 70*a* to said member 12*a*, and spaced top and bottom bars 71 and 72, the former of which is provided with a scale 73. A slide member 74 is guided between the bars 71 and 72 and has an indexing pin 75 that moves along the scale 73 as the slide member 74 moves longitudinally between the bars 71 and 72**.

An adjusting screw 76 extends into a threaded bore in the slide member 74 and is freely rotatable in the member 69. A threaded set collar 77 and a knurled thumb knob 78 hold the adjusting screw against end play. A pin **78*a* fixes the thumb knob 78 in place. Thus, as the adjusting screw 76 is rotated, it moves the slide member 74 longitudinally; and this motion is transmitted by the mechanical connection 58 that consists of a wire 79 carried as a core in a flexible cable sheath 80. The wire 79 has an end anchored to the slide member 74 and the cable sheath 80 has an end secured in the rearward guide block 70. As best seen in FIGS. 1 and 2, the flexible cable sheath 80 extends along the outside of the stream feeder frame member 12***a* and is held by a bracket 81 on the underside of the belt support 44 which is midway of an arc of the sheath between the frame member and the rear of the bifurcated member 64 into which the sheath extends centrally. The flexible cable sheath 80 is anchored in the rear of the bifurcated member by a set screw 80*a* (FIG. 5); and the cable 79 is anchored in the slide block 67 by a set screw 82. A compression spring 83 is seated in a well 84 in the bifurcated member 64 and bears upon the slide block 67 to bias the impaling pin bar 56 toward the most extended position of the impaling pins 63 and to eliminate excessive play between the cable 79 and the cable sheath 80 in the arc under the belt support 44.

As seen in FIG. 8, the front face of the forward journal block 69 is provided with an "in" legend and arrow 85 and an "out" legend and arrow 86, so that even an inexperienced machine attendant will not become confused as to the direction of rotation for producing the desired movement of the impaling pins 63. As seen in FIG. 1, the location of the thumb screw 78 of the manually movable adjustment control member 57 makes it readily accessible to a machine attendant who is standing in the usual walkway that extends along the side of the inserter chain C that is opposite the stream feeder 10; and the location of the scale 73 and indicator finger 75 locates them where they are readily visible to an attendant in that position.

Figure 3:
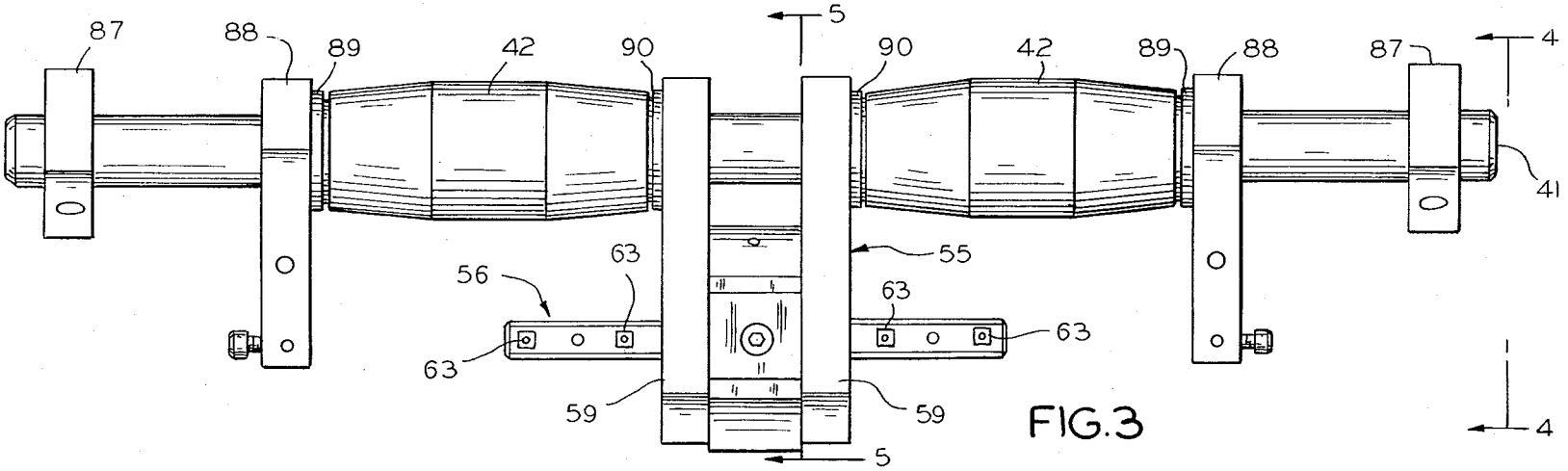
FIG. 3 is a transverse sectional view on an enlarged scale taken substantially as indicated along the line 3—3 of FIG. 2, illustrating the mounting of the pin bar upon a forward stream feeder shaft, with the stream feeder belts and frame omitted for clarity of illustration.

Referring now especially to FIGS. 2, 3 and 4, it is seen that the forward cross shaft 41 is provided with adjustable centering blocks 87 that position it properly between the stream feeder frame side rails 12*a* and 12*b*, and adjustable bearing mounts 88 carry thrust bearings 89 that cooperate with thrust bearings 90 in the support arms 59 to provide appropriate end journalling for the front belt rollers 42.

The foregoing detailed description is given for clearness of understanding only and no unnecessary limitations should be understood therefrom, as modifications will be obvious to those skilled in the art.

I claim:

1. In a stream feeder that has a frame, driven endless means on said frame for moving a shingled stream of signatures forwardly to maintain a small upright stack of signatures at a packer box of a bindery line collator that has means for separating signatures seriatim from the bottom of said small upright stack and feeding them into an endless gathering chain that moves along the forward ends of a line of such packer boxes, and a line of transversely spaced inpaling pins in said stream feeder to assist in separating said signatures, the improvement comprising, in combination:

a transversely extending impaling pin bar movably mounted on a forward end portion of the stream feeder frame immediately adjacent said small upright stack;

a line of impaling pins individually adjustably mounted in said pin bar, said pins having free ends projecting into the path of movement into the packer box of signatures in said small upright stack;

means for moving said pin bar to adjust the extent of projection of all said pins simultaneously, said means including a manually movable adjustment control member mounted at a position spaced from said pin bar where it is readily accessible to an operator who is attending the bindery line; and means for adjusting the angular position of all said pins simultaneously, said means providing angular position adjustment about a phantom axis at the tips of the pins.

2. The improvement of claim 1 which includes a mechanical connection between the adjustment control member and the pin bar.

3. The improvement of claim 2 which includes support means mounting the adjustment control member on an end of the stream feeder frame.

4. The improvement of claim 3 in which the stream feeder frame has a forward end above the packer box, and the support means is secured on said forward end where the adjustment control member is readily accessible to an operator who is positioned at the side of the gathering chain opposite the packer boxes.

5. The improvement of claim 3 in which the adjusting member is mounted for movement effectively lengthwise of the stream feeder frame.

6. The improvement of claim 5 in which the adjusting member is threaded and rotates in a threaded bore to produce said movement lengthwise of the stream feeder frame.

7. The improvement of claim 6 in which the mechanical connection comprises a flexible cable that is moved endwise by the adjusting member.

8. The improvement of claim 7 which includes an index scale on the stream feeder frame alongside the adjusting member, and an index pointer on the adjusting member in operative relationship to said index scale.

9. The improvement of claim 5 which includes an index scale on the stream feeder frame alongside the adjusting member, and an index pointer on the adjusting member in operative relationship to said index scale.

10. The improvement of claim 2 in which the mechanical connection comprises a flexible cable that is moved endwise by the adjusting member.

11. The improvement of claim 4 in which the mechanical connection comprises a flexible cable that is moved endwise by the adjusting member.

12. The improvement of claim 1 which includes a forward cross shaft in said forward end portion of the stream feeder frame, a pair of transversely spaced pin bar mounting arms supported on said cross shaft, means supported on said mounting arms defining a slideway, a slide block carried in said slideway, said slide block having a transverse bore in which the pin bar is mounted, and an operative connection between said slide block and the means for moving the pin bar.

13. The improvement of claim 12 which includes a mechanical connection between the adjustment control member and the slide block.

14. The improvement of claim 12 which includes means biasing the pin bar to maximize the extent of projection of the pins.

15. The improvement of claim 12 in which the forward cross shaft rotatably supports the front of the stream feeder endless means.

16. The improvement of claim 12 which includes fixed cross pins joining the mounting arms, the means defining a slideway comprises a bifurcated member, and means including said fixed cross pins supporting the bifurcated member for rotational adjustment on the mounting arms about the phantom axis at the tips of the pins.

* * * * *